US005678387A

United States Patent [19]

Aarts

[11] Patent Number: 5,678,387

[45] Date of Patent: Oct. 21, 1997

[54] METHOD FOR EVACUATING A VACUUM PACKAGE FILLED WITH GRANULAR MATERIAL AND APPARATUS FOR CARRYING OUT THE METHOD

[75] Inventor: Mathias Leonardus Cornelis Aarts, Bilthoven, Netherlands

[73] Assignee: Sara Lee/DE N.V., Utrecht, Netherlands

[21] Appl. No.: 564,016

[22] Filed: Nov. 29, 1995

[30] Foreign Application Priority Data

Nov. 29, 1994 [NL] Netherlands ..... 9402000

[51] Int. Cl.[6] ..... B65B 31/00

[52] U.S. Cl. ..... 53/434; 53/436; 53/512; 53/527

[58] Field of Search ..... 53/432, 434, 436, 53/437, 469, 510, 512, 523, 525, 526, 527; 141/51, 65; 220/371

[56] References Cited

U.S. PATENT DOCUMENTS

| | | | |
|---|---|---|---|
| 4,004,398 | 1/1977 | Larsson et al. | 53/527 |
| 4,154,045 | 5/1979 | Christensson | 53/527 |
| 4,449,243 | 5/1984 | Platel | 53/434 |
| 4,581,764 | 4/1986 | Plock et al. | 53/512 |
| 4,734,292 | 3/1988 | Van Boxtel | 53/434 |
| 4,949,529 | 8/1990 | Davis | 53/434 |
| 5,070,675 | 12/1991 | Chuan-Shiang | 53/512 |
| 5,097,648 | 3/1992 | Berner et al. | 53/512 |
| 5,220,768 | 6/1993 | Aarts | 53/526 |
| 5,392,589 | 2/1995 | Buchanan | 53/412 |
| 5,528,880 | 6/1996 | Landolt | 53/512 |

FOREIGN PATENT DOCUMENTS

| | | | |
|---|---|---|---|
| 475514 | 3/1992 | European Pat. Off. . | |
| 1943572 | 3/1971 | Germany . | |
| 7101123 | 8/1972 | Netherlands . | |
| 1511171 | 9/1989 | U.S.S.R. | 141/51 |

*Primary Examiner*—John Sipos
*Assistant Examiner*—Ed Tolan
*Attorney, Agent, or Firm*—Keck, Mahin & Cate

[57] ABSTRACT

Method and apparatus for evacuating a vacuum package made from a thin-walled and flexible packaging material and filled with granular material. An open end of a filled package is folded in such a manner that a narrow gap is formed which constitutes an open communication between an interior and an exterior of the package. At least a part of the package is placed in a vacuum space and vacuumized for removing gasses from the package through the gap. Upon evacuation the package is sealed airtightly. Further, on at least a part of the packaging material defining the gap a force is exerted which reduces the gap width, so that the gap constitutes a filter for the granular material, whereby the granular material is retained inside the package during the evacuation of the package.

42 Claims, 7 Drawing Sheets

METHOD FOR EVACUATING A VACUUM PACKAGE FILLED WITH GRANULAR MATERIAL AND APPARATUS FOR CARRYING OUT THE METHOD

This invention relates to a method for evacuating a vacuum package made from a thin-walled and flexible packaging material and filled with granular material, wherein an open end of a filled package is folded in such a manner that a narrow gap is formed which constitutes an open communication between an interior and an exterior of the package, at least a part of the package is placed in a vacuum space and vacuumized for the purpose of removing gasses from the package via the gap, and the package is airtightly sealed after the evacuation.

The invention also relates to an apparatus for evacuating a vacuum package made from a thin-walled and flexible packaging material and filled with granular material, with an open end of a filled package having been folded in such a manner that a narrow gap is formed which constitutes an open communication between an interior and an exterior of the package, comprising a vacuum space for placing therein at least a part of the package and a vacuum element for vacuumizing the vacuum space, so that gasses are removed from the package via the gap.

The granular material may for example consist of ground coffee, nuts such as peanuts and other products.

Such a method and apparatus are known, for instance, from Dutch patent application no. 9001945, where the gas pressure in the vacuum space is gradually reduced over a period of approximately 10 seconds to a level of approximately 50 mB. During these 10 seconds the gas pressure in the package will fall to approximately the same extent as in the vacuum space, with the result that gasses are removed from the package. If after the above-mentioned 10 seconds the gas pressure has fallen to approximately 50 mB, the package has been evacuated to a sufficient extent and can subsequently be sealed airtightly.

Presently, there is a desire to be able to carry out the entire evacuation process much faster than in the above-described 10 seconds.

To realize this object, in accordance with the invention, on at least a part of the packaging material defining the gap a force is exerted which reduces the gap width, so that the gap constitutes a filter for the granular material, whereby the granular material is retained within the package during the evacuation of the package. The action of the filter enables extra fast evacuation. When the air pressure in the vacuum space is reduced very fast, the gasses will be driven from the package via the gap with increased velocity. As a result of the high velocity of the gas streams generated in the package, the particles of the granular material will tend to be entrained. However, by virtue of the gap working as a filter, these granular materials cannot leave the package, since the granular materials cannot open the gap to a sufficient extent to enable their escape from the package. If the gas pressure in the vacuum space is reduced very fast, for instance within 0.1 seconds, to the desired vacuum level of, for instance, 50 mB, the gas pressure in the package will likewise decrease and after approximately 0.8 seconds be equal to the gas pressure in the vacuum space. This means that the package, after this pressure in the package has been achieved, has been evacuated sufficiently and can be sealed. As a result of all this, the entire evacuation process according to the invention can be carried out a factor of 10 faster than the above-described prior art process.

Preferably, at least a part of the packaging material defining the gap is placed between two members, with at least one member being pressed in the direction of the other member. This concerns a very practical procedure for carrying out the method.

In particular, a part of the packaging material defining the gap comprises a thickening constituting a spacer co-determining the minimum gap width. The resultant achievement is that the gap width is not reduced to an extent where the gasses can escape from the package only slowly or cannot at all. In accordance with this particular variant of the invention, therefore, an optimum setting of the gap width is realized, with the width being sufficiently small to prevent granular particles from leaving the package and with the width being sufficiently large to allow the gasses to evacuate from the package at a high flow velocity during the evacuation process.

More particularly, at least a part of the thickening consists of at least two mutually connected layers of packaging material. In accordance with the invention, this can be simply realized when a package is used which is made up of a case composed of at least one sheet of packaging material, having a sidewall provided with a welding seam composed of at least two overlapping parts of packaging material. Also, such a thickening can be provided in a very simple manner when at least a part of the thickening consists of at least two layers of packaging material folded over each other. In particular, the case is rectangular in shape with four edge portions of the sidewalls of the case being folded inwards before the package is evacuated.

According to a highly advantageous embodiment of the invention, the package is airtightly sealed at a position located between the position where the above-mentioned force is applied and an open end of the gap. This provides an advantage in that no granular material can be disposed at the position where the package is sealed. It is thus ensured that a proper airtight seal is obtained when the package is closed, for instance by heat-sealing the gap.

In a possible further elaboration of the method, the gas pressure in the vacuum space is reduced to a level corresponding with a desired vacuum level in the package after said part of the package has been placed in the vacuum space. Thereafter the gas pressure in the vacuum space is maintained at said pressure level for a particular period, so that the gas pressure in the package will fall until the desired vacuum level in the package has been achieved, whereafter the package is closed. In particular, the desired vacuum level in the package is equal to the vacuum level in the vacuum space when in the vacuum space a gas pressure prevails at said pressure level. The gas pressure in the package will then decrease approximately following an e-power, until the gas pressure within the package is equal to the gas pressure in the vacuum space.

According to a highly advantageous embodiment of the invention, the entire package is introduced into the vacuum space for evacuating the package, with the contents of the package being compressed for at least a part of the time period in which the package is evacuated. This provides the advantage that the package will acquire a smooth surface after evacuation. Because the entire package is placed in the vacuum space, the package will tend to swell directly after the gas pressure inside the vacuum space has strongly decreased, since the gas pressure within the package will decrease less fast than the gas pressure in the vacuum space outside the package. By simultaneously compressing the contents of the package, the package is prevented from exploding and also the packaging material is caused to stretch under the influence of the momentarily higher pressure inside the package and the counterpressure on the outside thereof.

In particular, to this end, for the purpose of carrying out said compression, the package is placed in a sack-shaped body made of elastic material and of double-walled design, which sack-shaped body is inflated by the supply of compressed air between the double walls, so that the inner wall of the sack-shaped body is pressed against the package.

An even smoother surface is obtained when the package is compressed in the above-mentioned manner by pressing reciprocable rigid plate-shaped elements against the walls of the package. Preferably, these plate-shaped elements are placed between the inner wall of the sack-shaped body and the outside of the package.

According to a variant of the invention, a spacer is introduced into at least a part of the inside of the gap before the package is evacuated. This method finds application in particular when the package is not provided with the above-mentioned thickening.

The apparatus according to the invention may be provided with pressure means for exerting a force on at least a part of the foil defining the gap, in a direction which reduces the width of the gap, so that the gap constitutes a filter for the granular material, as a result of which the granular material is retained within the package during the evacuation of the package.

The invention will be further explained, by way of example, with reference to the accompanying schematic drawings, wherein.

Figure 1:
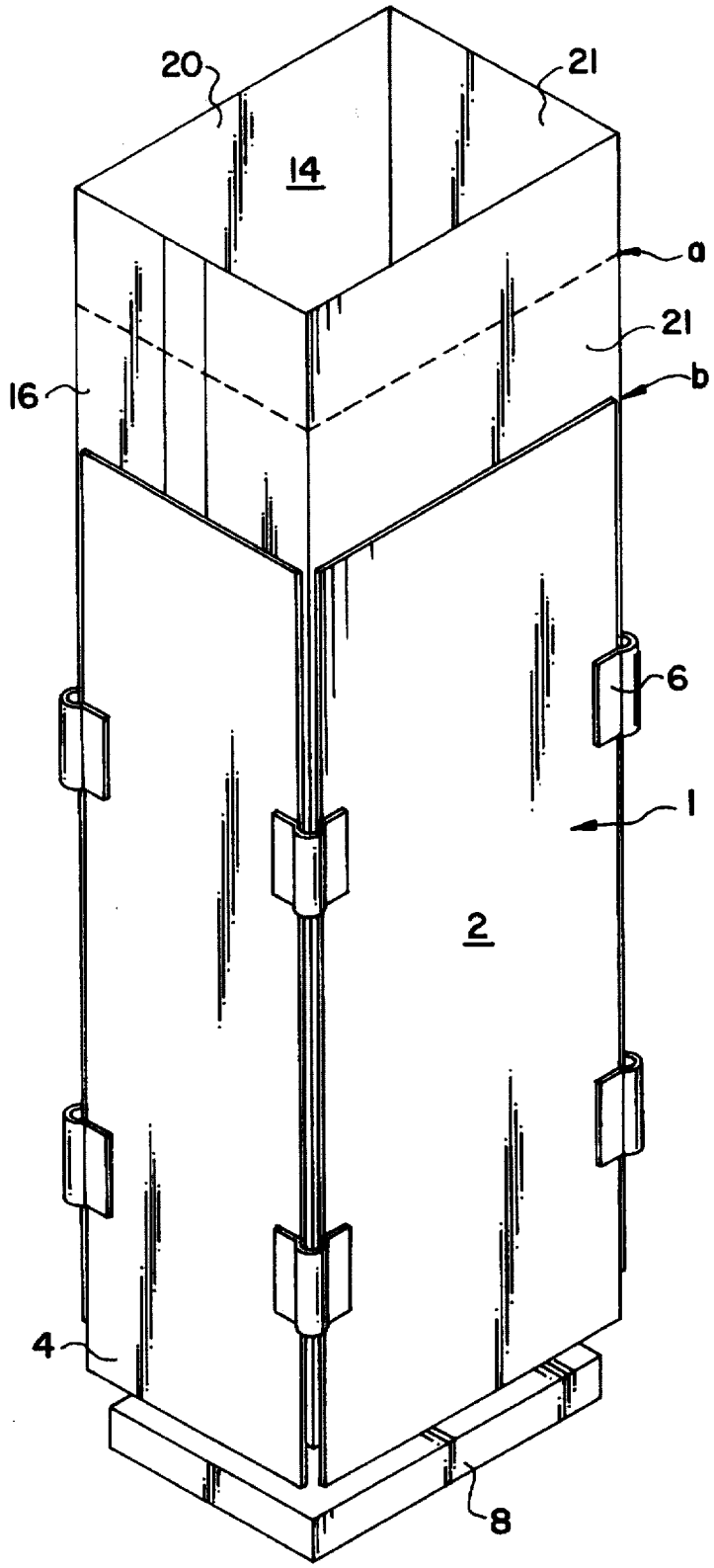
FIG. 1 shows a holder with walls movable towards each other, for use in the invention, with a package, open at the top, placed in the holder.
Figure 2:
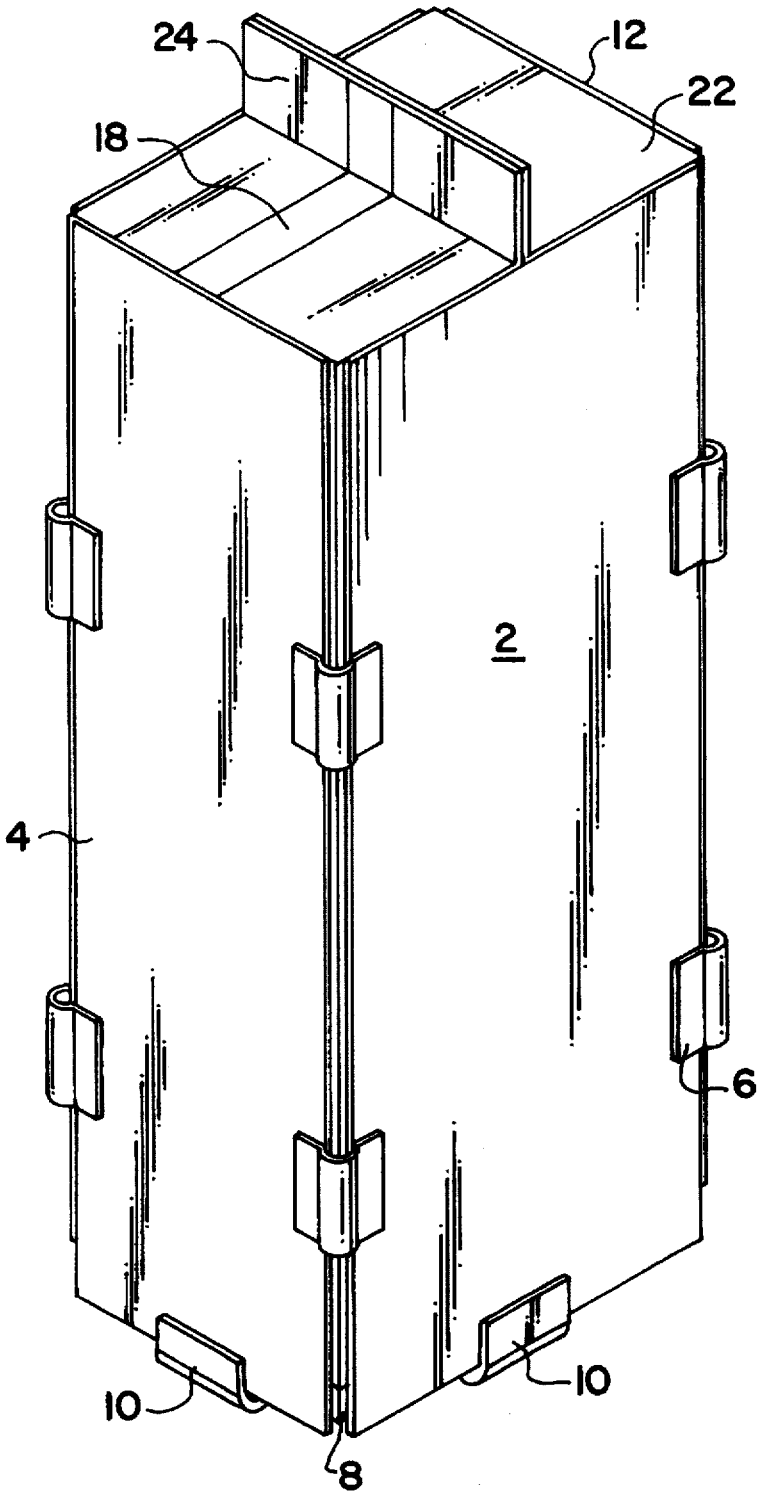
FIG. 2 shows the holder of FIG. 1 after the package has been folded up at the top.
Figure 3:
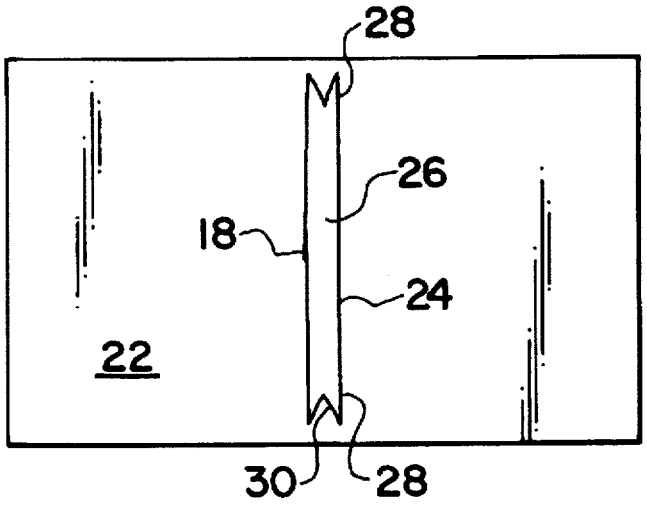
FIG. 3 is a top plan view of the package according to FIG. 2.
Figure 8:
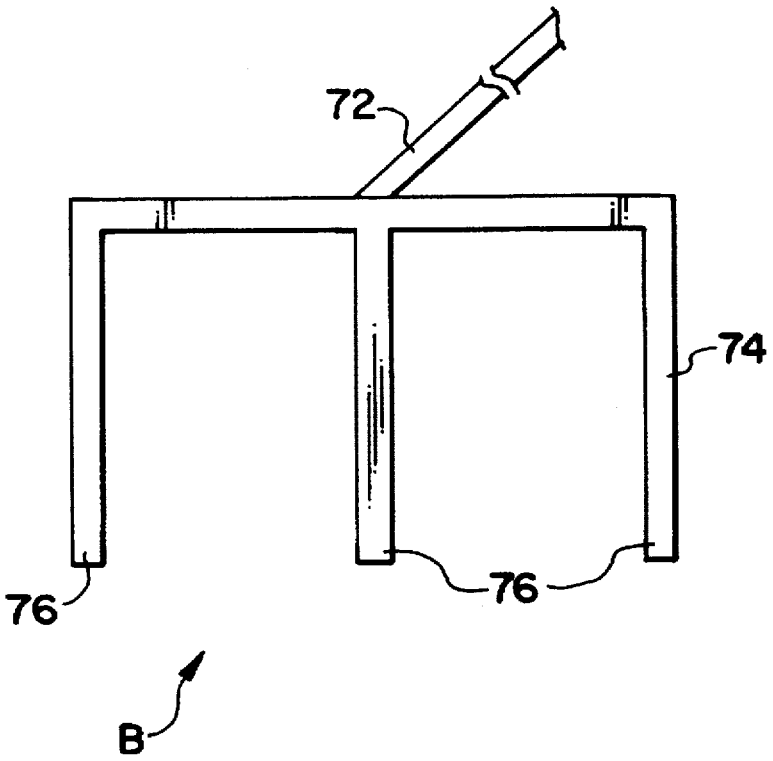
FIG. 8 shows a spacer of the apparatus according to FIG. 7.
Figure 4:
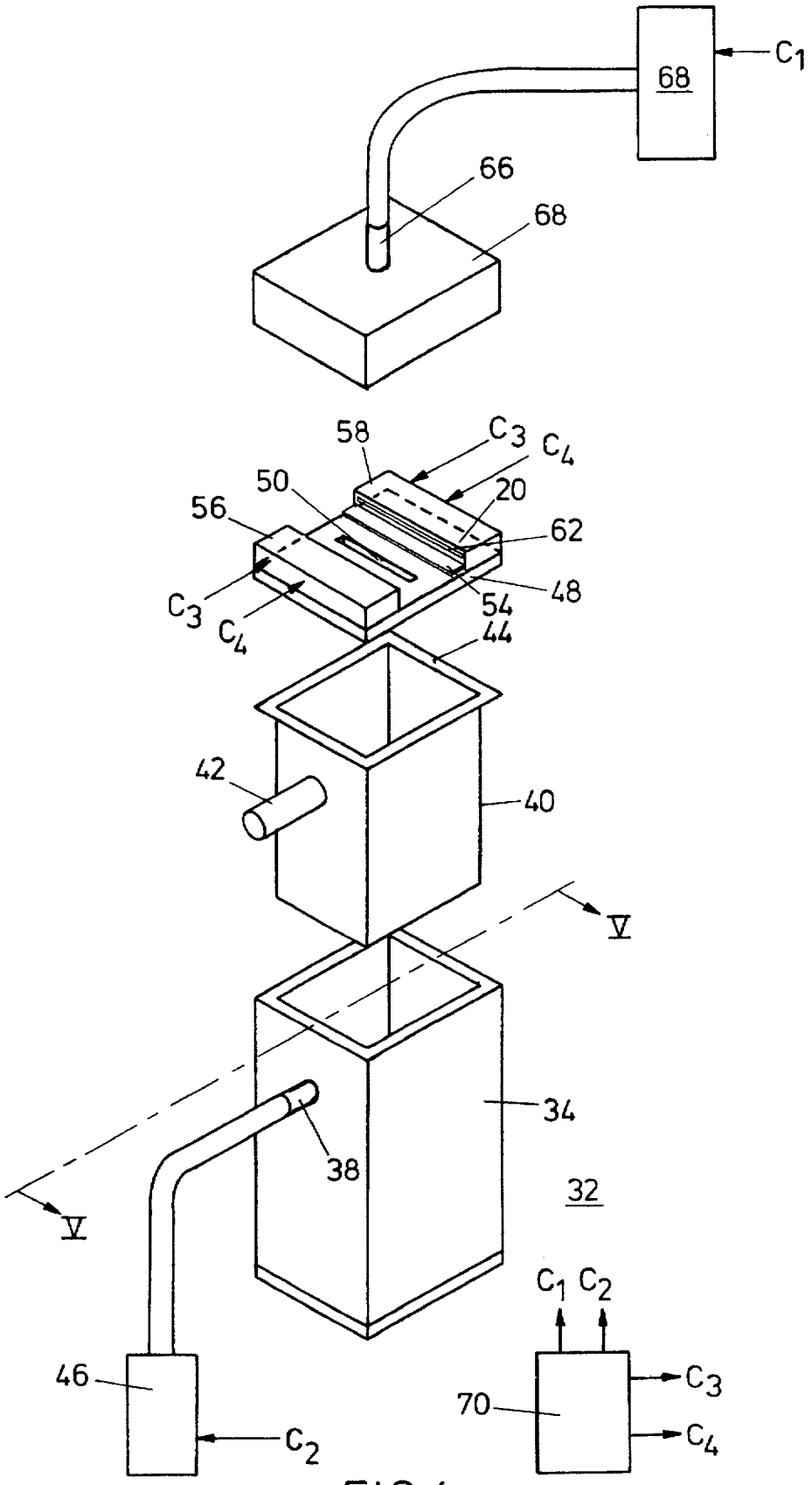
FIG. 4 shows an apparatus according to the invention for carrying out a method according to the invention.
Figure 5:
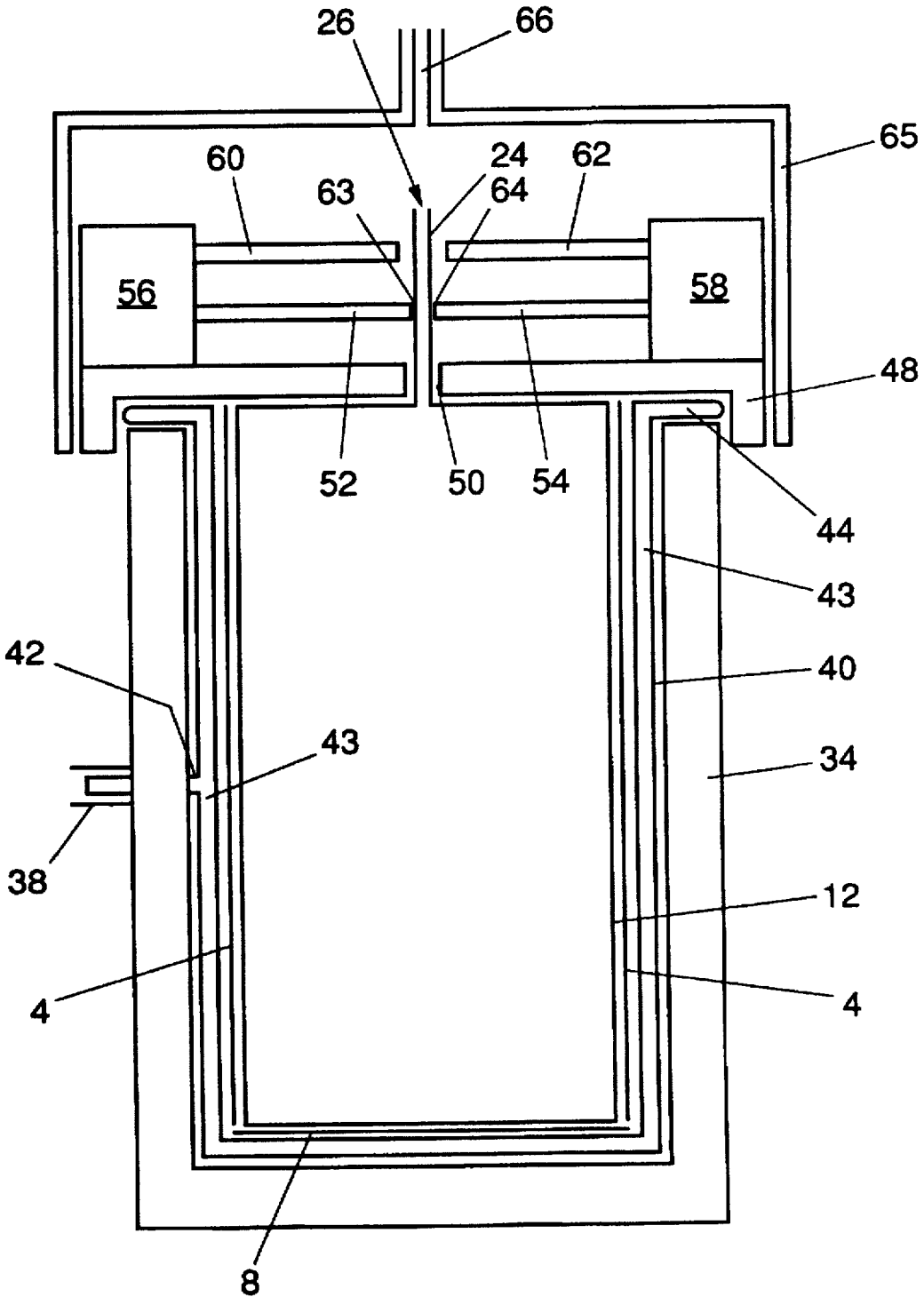
FIG. 5 is a cross-sectional view of the apparatus according to FIG. 4 having arranged therein the package placed in the holder as shown in FIG. 2.

FIG. 1 shows a holder 1 comprising a pair of parallel, rectangular rigid plate-shaped elements 2 and a second pair of similar elements 4. These plates 2 and 4 enclose a space of rectangular section. Adjacent plates 2 and 4 are joined together by resilient hinges 6. Each hinge 6 consists of two small plates fixedly secured to a plate 2 or 4 and connected to each other through a resilient or otherwise suitably flexible intermediate member. The hinges 6 allow a slight displacement of the plates 2 and 4 coupled by a hinge, in mutually perpendicular directions. Disposed between the lower ends of the plates 2, 4 is a rigid and flat bottom plate 8 of the holder 1. As shown in FIG. 2, the bottom plate 8 is connected to the lower ends of the plates 2, 4 through hinges 10, similar to those between the plates 2 and 4 (FIG. 1 shows the bottom plate 8 prior to assembly in the holder and without hinges). By virtue of the hinges 10, the bottom plate 8 can be subjected to a slight displacement in vertical direction between the four plates 2, 4 of the holder 1. The dimensions of the holder are such that a preformed package 12 can be placed therein, preferably with little clearance, with the lower end of the package 12 coming to rest on the bottom plate 8. In this example, the package 12 is made up of a sheet of thin-walled and flexible packaging material which has been formed into a case 14. Accordingly, a sidewall 16 of the package comprises a welding seam 18 extending in the longitudinal direction of the package. In this example the welding seam 18 consists of two layers of packaging material which have been sealed together in a manner which is known per se. At its lower end, likewise in a known manner, the case 14 has been folded up and sealed airtightly. The welding seam 18, too, involves an airtight seal. In FIG. 1 the uppermost portion of the package projects from the upper end of the holder 1. By way of its open upper end 20, the package 12 is filled with a granular material, such as for instance ground coffee. The package is filled to the level a, such as it is shown in FIG. 1. If desired, not an empty package but a package previously filled to level a is placed in the holder. The holder 1 with the filled package 12 arranged therein is now subjected to a vibratory movement, so that the level of the filling drops to level b flush with the upper edge of the holder 1. The open end 20 of the package 12 is now folded up by folding inwards four edge portions of the four sidewalls of the package. As a result, a horizontal top surface 22 is obtained, having an upright edge 24 in the middle thereof. Formed between the walls of the upright edge 24 is a gap 26 through which air can flow out from the interior of the package. FIG. 3 is a top plan view of the package shown in FIG. 2. Adjacent the upright side edges 28 of the upright edge 24, parts 30 of the packaging material have been folded inwards. As will be explained hereinafter, the welding seam 18 and the inwardly folded parts 30 form a thickening which constitutes a spacer co-determining the width of the gap. FIGS. 4 and 5 show an embodiment of an apparatus for evacuating the package shown in FIGS. 1, 2 and 3. The apparatus 32 comprises a rigid rectangular chamber 34, open at the top. Fitted on the external wall of the chamber 34 is a connection 38 for the supply of compressed air. Fitting into the chamber, with preferably little clearance, is a correspondingly shaped double-walled and flexible sack 40, manufactured from, for instance, rubber. The sack 40 comprises a connection 42 which communicates with the space between the double walls of the sack 40. When placed into the chamber 34, the sack 40 has a flanged upper edge 44 resting on the flat upper edge of the chamber, with the bottom of the sack resting on the bottom of the chamber. The connection 42 of the sack fits into the connection 38 of the chamber, the arrangement being such that the outside of the connection 42 is connected airtightly with the inside of the connection 38. The apparatus further comprises a compressed air element in the form of a pump 46 with which air can be forced via the connection 38 into the space between the double walls of the sack 40.

The apparatus further comprises a plate 48 having a slot 50 therein. Disposed above the plate 48 are pressure means in the form of two members 52, 54 which can be moved towards each other using means 56, 58 which are known per se. The apparatus further comprises sealing means in the form of two sealing jaws 60, 62 likewise disposed on opposite sides of the slot 50. The members 52, 54 and the sealing jaws 60, 62 are shown diagrammatically in FIG. 5. The sealing jaws 60, 62 can also be moved towards each other using the means 56, 58.

The members 52, 54 in this case consist of two horizontal plates having free ends formed by longitudinal edges 63, 64, which extend parallel to the slot 50. The apparatus further comprises a cover 65 to be arranged on the chamber 34. The cover 65 comprises in the middle thereof a connecting piece 66 to which a vacuum element 68 can be connected. The apparatus further comprises a control unit 70, which generates signals C1 and C2 for activating the vacuum element 68 and the pump 46, respectively. The control unit 70 further generates signals C3 and C4 for moving the members 52, 54 towards each other and activating the sealing jaws 60, 62, respectively.

The apparatus according to the invention operates as follows. Together with the holder 1, the package 12 filled with granular material is placed into the sack 40 which has priorly been placed in the chamber 34 or is secured therein. The dimensions of the holder 1 and the sack 40 are preferably such that the holder with the package can easily, but with little clearance, be fitted into the sack, with the bottom of the holder coming to rest on the bottom of the sack. The upper edge of the holder, and hence also the flat portion 22 of the upper end of the package 12, end up level with the upper edge of the chamber 34 and the flange 44 of the sack sitting thereon. The chamber 34 can now be closed from above with the horizontal plate 48. The underside of the plate 48 is then disposed against or close to the top surface of the package 12. The upright edge of the package 12 projects through the slotted opening 50 in the plate 48. Then the cover 65 is arranged on the chamber 34. This situation is shown in FIG. 5. Thus, a vacuum space has been obtained, which is formed by the inside of the cover 65 and the space formed between the outside of the package 12 and the inside of the flexible sack 40. The control unit now generates a signal C3 whereby the members 52 and 54 are moved towards each other. These members, when engaging the upright edge 24, will function as pressure means for exerting a force on at least a part of the packaging material defining the gap, in a direction in which the width of the gap is reduced. However, the gap 26 will not be pressed shut entirely, due to the welding seam 18 and the folded parts 30 functioning therewith as a spacer by which the minimum gap width is determined. If, for instance, the thickness of the packaging material is approximately 100 microns, the gap width in an area located adjacent the folded parts 30 will be approximately 200 microns. In addition, the gap width in an area located adjacent the welding seam 18 will be approximately 100 microns. Such a gap width has the characteristic of allowing gasses from the package to flow readily through the gap, while the granular material cannot leave the package through the gap because the gap width is less than the least diameter of a granule of the granular material. Thus the gap 26 has the characteristic of forming a filter for the granular material, while gasses such as, for instance, air are allowed to pass. From a statistical point of view, the gap width could be set so as to be less than the average least diameter of a granule.

Figure 6:
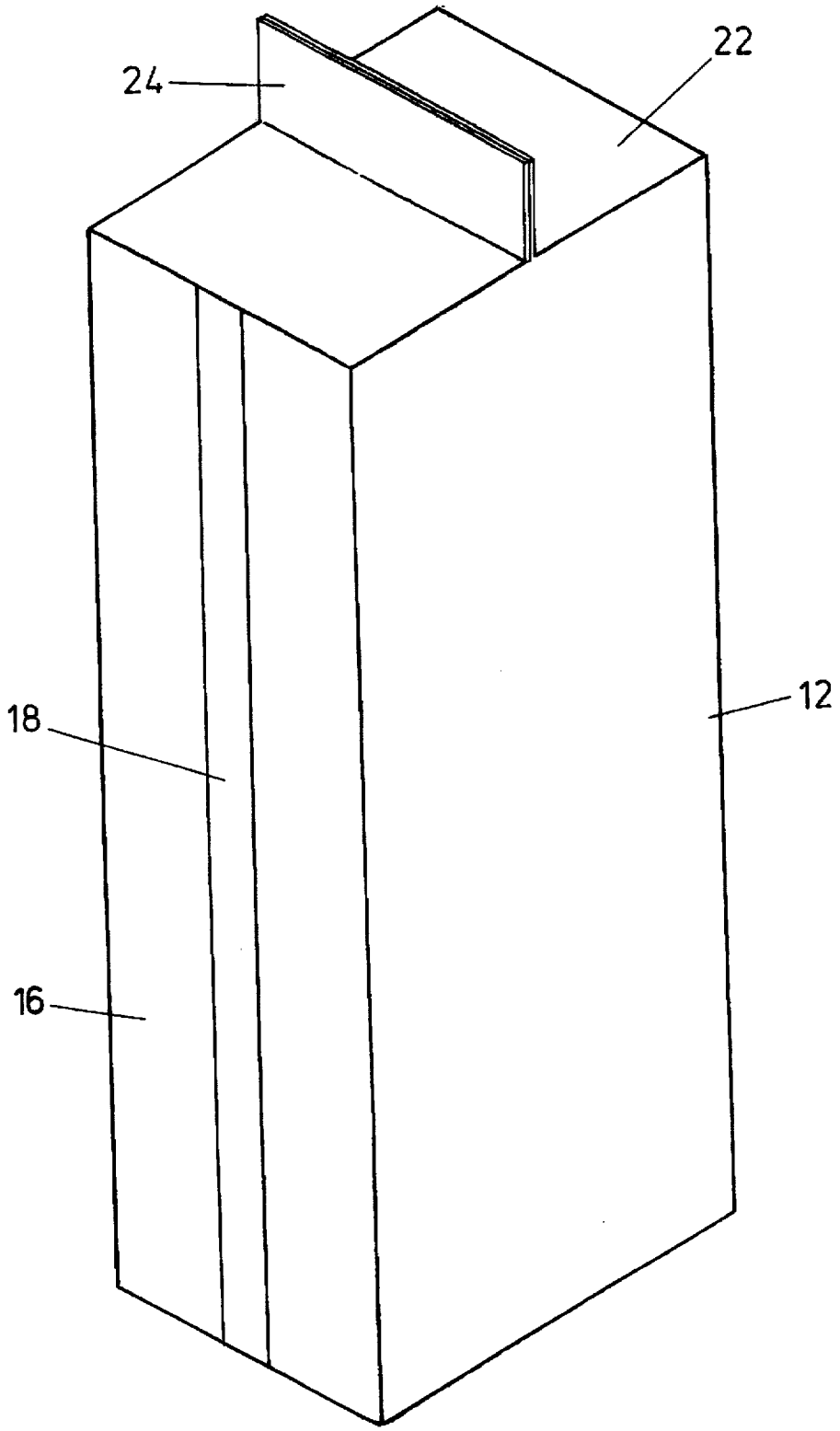
FIG. 6 shows the finished package upon removal from the apparatus.

After the gap width referred to has been set, the control unit 70 generates a signal C1 with which the vacuum element 68 is activated. More or less simultaneously, a signal C2 is generated, with the result that the pump 46 pumps compressed air into the space 43 formed between the double walls of the sack 40. After the control unit 70 has activated the vacuum element 68, the pressure in the vacuum space is reduced very quickly to a level corresponding with a desired vacuum level in the package. This happens so fast that the pressure in the package will at least temporarily be higher than the pressure in the vacuum space. As a result, the package 12 will tend to swell. Because compressed air is supplied to the sack 40, the sack has its outside pressed against the walls and bottom of the chamber 34 and is simultaneously pressed against the plate-shaped elements 2, 4. The result is that the contents of the package are compressed by the plate-shaped elements 2, 4, functioning as pressure means. As a result of the swelling of the package on the one hand and the compression of the package on the other, the packaging material is stretched and acquires a completely flat appearance. Simultaneously, gasses present in the package will flow from the package with great velocity since the pressure in the package is momentarily greater than the pressure in the vacuum space. In spite of the fact that the gas stream leaving the package through the gap is very strong, the granular particles will not be sucked from the package because the gap functions as a filter, as explained hereinbefore. However, the gas stream may be so strong that the granular material is sucked towards the gap of the package. After a very short time, the pressure inside the package will be equal to the pressure in the vacuum space. This means that the package has been evacuated. The control device 70 then delivers a signal C4, whereby the sealing jaws 60, 62 are activated and seal the upright edge 24 airtightly. Thereafter the control unit 70 will generate signals C3 and C4, which have as a consequence that the members 52, 54 and sealing jaws 60, 62, respectively, are moved away from each other. Also, the vacuum element 68 and the pump 46 are switched off. The cover 65 and the plate 48 can now be removed, whereafter the finished package 12 can be taken from the chamber 34. The package thus obtained is depicted in FIG. 6.

The gas pressure in the vacuum space can for instance be reduced within 0.2 seconds to a pressure level at which the package is evacuated. More particularly, the gas pressure in the vacuum space is reduced within 0.1 seconds to the level referred to. In practice, the vacuum level of the vacuum space will correspond with a gas pressure of less than 100 mB. However, if the vacuum to be obtained in the vacuum package is required to meet high standards, the gas pressure can be reduced to a value of, for instance, less than 50 mB. After this gas pressure in the vacuum space has been set, the gas pressure within the vacuum package will decrease very quickly. On physical grounds, such a decrease will follow an e-power. As a result of all this, the package can be sealed approximately 0.7–2 seconds after the gas pressure in the vacuum space has been reduced. When the package is sealed, the pressure in the package will be approximately equal to the pressure in the vacuum space. Depending on the type of granular material, it is even possible that the gas pressure in the package takes the value corresponding with the gas pressure in the vacuum space after approximately 1–1.5 seconds. This means that approximately 1–1.5 seconds after the gas pressure in the vacuum space has fallen to the level referred to, the package can be sealed airtightly. In general, the gas pressure in the vacuum chamber will be reduced, for instance, in a time period less than a third of the time period in which the package is evacuated after the pressure in the vacuum space has been reduced to the level referred to.

Precisely at the position where the members 52 and 54 are located, the slot will behave as a filter. This means that within the slot at the positions located above the members 52 and 54 no granular material can be present. Because, accordingly, the slot is completely clean at the last-mentioned position, the package can advantageously be sealed airtightly precisely at this point. For that reason, the sealing jaws 60, 62 are disposed above the members 52, 54.

Figure 7:
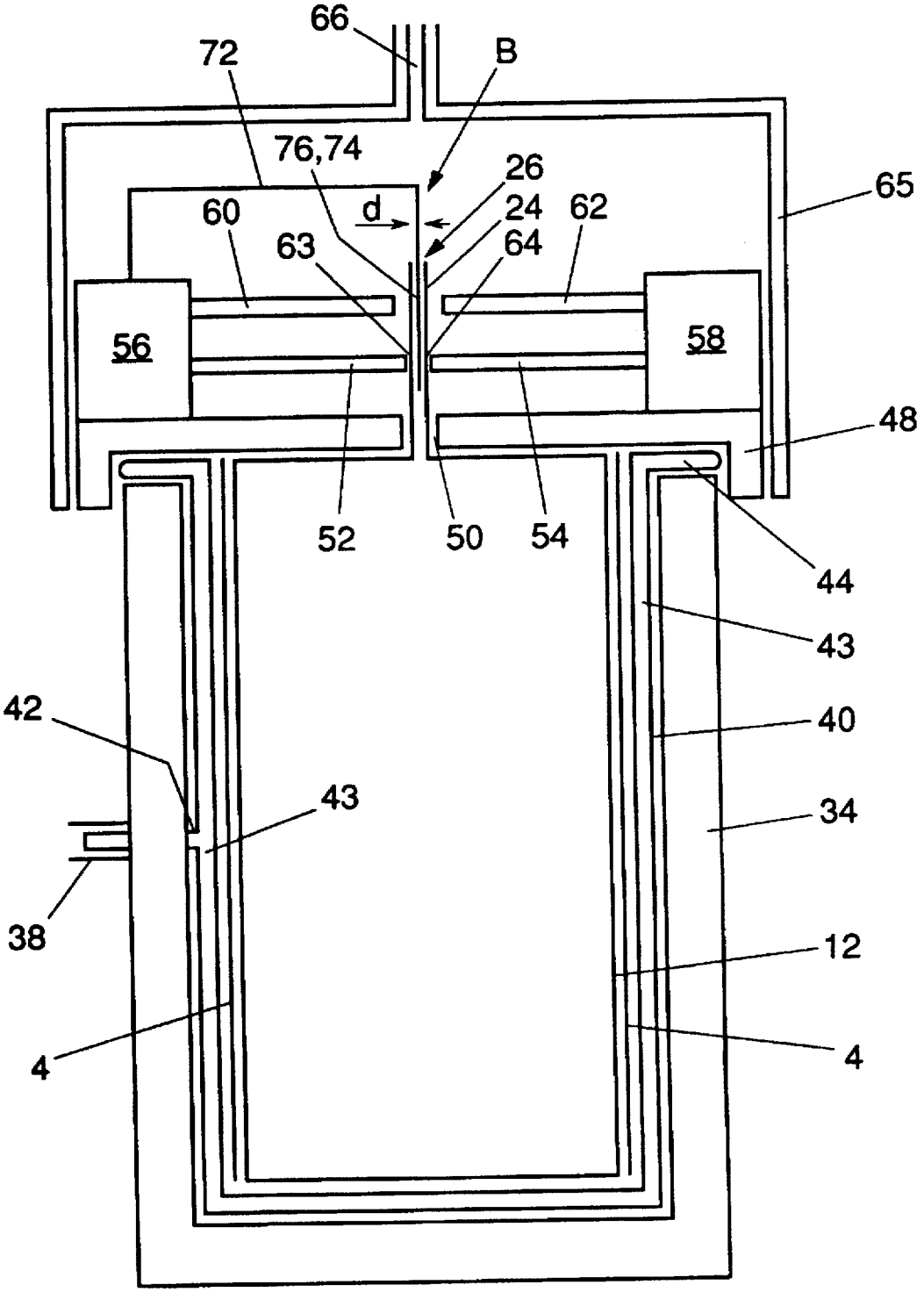
FIG. 7 shows an alternative embodiment of an apparatus according to the invention for carrying out a method according to the invention.

FIG. 7 shows an alternative embodiment of an apparatus according to the invention, in which parts corresponding with FIG. 5 are provided with the same reference numerals. The apparatus according to FIG. 7 comprises a spacer 72, of which a vertically directed forked end 74 can be inserted into the gap. The spacer 72 can be moved up and down in vertical direction using the means 56. When the package 12 is placed in the chamber 34, the spacer 72 is moved downwards, so that fingers 76 of the forked end 74 are introduced into the gap. When the spacer 72 is in an extreme lower position, the fingers 76 extend to below the members 52 and 54. When thereupon the members 52 and 54 are moved towards each other and urge the gap in the direction of a closed position, the fingers 76 will prevent the gap from being closed entirely. The fingers 76 thus have a function comparable with the above-discussed thickenings in packaging material, which thickenings are formed by the welding seam 18 and the inwardly folded parts 30. The thickness d of the fingers will preferably be 70–150 μm. Accordingly, also when the package 12 is provided with an envelope which comprises no welding seam, while moreover the edge portions 21 are folded in such a manner that a gap is formed without layers of packaging material being folded onto each other, a gap functioning as a filter can be realized.

It will be clear that the invention is not in any way limited to the above-described embodiments. For instance, the plate-shaped elements 2, 4 and the bottom 8 can be simply omitted. In that case, too, upon evacuation a very smooth, i.e. non-wrinkled package will be obtained, while the upright walls of the finished package will be slightly convex. It is also possible to omit the entire flexible sack 40. In that case it is relevant for the package 12 to be placed in the chamber 34 with a reasonable fit. The above-mentioned vacuum space is now formed by the space in the cover and the space extending between the outside of the package and the inside of the chamber. If the vacuum space is evacuated in the fast way described hereinabove, the package will again bulge slightly and have its sidewalls pressed against the internal walls of the chamber 34. Thereafter the package will be evacuated in the manner described hereinabove, i.e. gasses will flow from the package via the gap to the vacuum space with a high velocity and be further removed. When the pressure inside the package is approximately equal to the pressure in the vacuum space, or when the pressure inside the package has dropped to a desired level, the package can be sealed airtightly by means of the sealing jaws 60, 62. This last holds equally for the apparatus according to FIG. 5 or 7. It is also possible that the vacuum space will not extend to the space present between the package and the chamber 34. This can for instance occur when the apparatus according to FIG. 5 or 7 comprises sealing means disposed in the slot 50. In other words, the vacuum space will then extend exclusively inside the cover 65. If the vacuum space is evacuated, the package will therefore not bulge as described hereinbefore. After evacuation of the package, it can be sealed by means of the sealing jaws 60, 62 in the manner described above. However, the finished package will then not comprise a completely smooth outer surface. Also, according to, for instance, a method described in Dutch patent application 9001945, it can be checked whether a package has been properly sealed airtightly. These and other obvious variants are all considered to fall within the scope of the invention.

I claim:

1. A method for evacuating a vacuum package made from a thin walled and flexible packaging material and filled with granular material comprising the steps of:

folding an open end of a filled package so as to form a narrow gap which constitutes a communication between an interior and an exterior of the package;

providing a spacer in only a part of the gap;

exerting a force on at least a part of the packaging material defining the gap which reduces a gap width so that the spacer closes only a part of the gap and leaves other parts of the gap open to form a filter for the granular material;

placing at least a part of the package in a vacuum space;

removing gasses from the package via the gap by applying a vacuum to the vacuum space;

retaining the granular material within the package during evacuation of the package by the filter; and sealing the package airtightly after evacuation.

2. A method according to claim 1, and further comprising the steps of placing a part of the packaging material defining the gap between two members and moving at least one of said members in the direction of the other of said members.

3. A method according to claim 1, and further comprising the step of determining the gap width by a thickening in part of said packaging material forming said spacer.

4. A method according to claim 3, and further comprising the step of forming at least a part of the thickening of at least two interconnected layers of the packaging material.

5. A method according to claim 4, and further comprising the step of providing, for use as said filled package, a package which is made up of a case with a sidewall provided with a welding seam composed of at least two overlapping portions of packaging material.

6. A method according to claim 5, and further comprising the step of forming at least a part of the thickening of at least two layers of the packaging material folded over each other.

7. A method according to claim 6, characterized in that the case is rectangular in shape and further comprising the step of folding four edge portions of the sidewalls of the case inwards before the package is evacuated.

8. A method according to claim 1, and further comprising the step of reducing the gas pressure in the vacuum space and maintaining the reduced gas pressure in the vacuum space for a particular period so that the gas pressure in the package will decrease until the desired vacuum level in the package has been achieved.

9. A method according to claim 8, characterized in that the gas pressure in the vacuum chamber is reduced to a level corresponding with the desired vacuum level in the package.

10. A method according to claim 8, characterized in that the gas pressure in the vacuum chamber is reduced so fast that the granular material is sucked towards the gap.

11. A method according to claim 8, characterized in that the gas pressure in the vacuum chamber is reduced in a time period less than a third of the time period in which the package is evacuated.

12. A method according to claim 8, characterized in that the gas pressure in the vacuum space is reduced within 0.2 seconds to a pressure level at which the package is evacuated.

13. A method according to claim 12, characterized in that the gas pressure in the vacuum space is reduced within 0.1 seconds to said level.

14. A method according to claim 12, characterized in that the gas pressure in the vacuum space is reduced to a value of less than 100 mB.

15. A method according to claim 1, characterized in that the package is sealed airtightly approximately 0.7–2 seconds after removing gasses from the package.

16. A method according to claim 13, characterized in that the package is sealed airtightly approximately 1–1.5 seconds after the gas pressure in the vacuum space has decreased to said level.

17. A method according to claim 3, characterized in that the package is sealed airtightly at a position located between the position where said force is exerted and an open end of the gap.

18. A method according to claim 1, characterized in that the entire package is introduced into the vacuum space for evacuating the package, and further comprising the step of compressing contents of the package during at least a part of the time period in which the package is evacuated.

19. A method according to claim 18, and further comprising the steps of placing the package, for the purpose of carrying out said compression, in a sack-shaped body made of elastic material and of double-walled design, and inflating the sack-shaped body through the supply of compressed air between the double walls so that the internal wall of the sack-shaped body is pressed against the package.

20. A method according to claim 19, characterized in that the package is compressed by pressing reciprocable rigid plate-shaped elements against the walls of the package.

21. A method according to claim 20, characterized in that said plate-shaped elements are arranged between the internal wall of the sack-shaped body and the outside of the package.

22. A method according to claim 18, characterized in that during the compression of the package the bottom and the top surface of the package are also pressed towards each other.

23. A method according to claim 1, characterized in that the spacer is introduced into the gap before exerting the force on at least a part of the packaging material defining the gap.

24. An apparatus for evacuating a vacuum package made from a thin-walled and flexible packaging material and filled with granular material, with an open end of a filled package having been folded in such a manner that a narrow gap is formed which constitutes an open communication between an interior and an exterior of the package, comprising:

a vacuum space for receiving therein at least a part of the package which includes an open end of the gap;

a vacuum element for vacuumizing the vacuum space so that gasses are removed from the package through the gap;

pressure means for exerting a force on at least a part of the packaging material defining the gap in a direction which reduces the width of the gap; and a spacer which is introduced into the gap during evacuation for setting the gap width in collaboration with the pressure means so that the gap constitutes a filter for the granular material and acts to retain the granular material inside the package during evacuation of the package.

25. An apparatus according to claim 24 characterized in that said pressure means comprise at least two members arranged for movement relative to each other, between which, in use, at least a part of the packaging material defining the gap is placed, while at least one of the two members can be pressed towards the other member for reducing the width of the gap.

26. An apparatus according to claim 1, and further comprising sealing means for airtightly sealing the filled package at a position which, in use, is located between the position where said force is exerted and an open end of the gap.

27. An apparatus according to claim 26, characterized in that the pressure means and sealing means are disposed inside the vacuum space.

28. An apparatus according to claim 26, and further comprising a control unit which controls the vacuum element in such a manner that the gas pressure in the vacuum space is reduced to a level corresponding with a desired vacuum level in the package and that the reduced gas pressure in the vacuum space is maintained for a particular period, so that the gas pressure in the package will decrease until the desired vacuum level in the package has been achieved.

29. An apparatus according to claim 28, characterized in that the control unit controls the vacuum element in such a manner that the gas pressure in the vacuum chamber is reduced to a level corresponding with the desired vacuum level in the package.

30. An apparatus according to claim 28, characterized in that the control unit controls the vacuum element in such a manner that the gas pressure in the vacuum chamber is reduced so fast that the granular material is sucked towards the gap.

31. An apparatus according to claim 28, characterized in that the control unit controls the vacuum element in such a manner that the gas pressure in the vacuum chamber is reduced in a time period less than a third of the time period in which the package is evacuated.

32. An apparatus according to claim 28, characterized in that the control unit controls the vacuum element in such a manner that the gas pressure in the vacuum space is reduced within 0.2 seconds to a pressure level at which the package is evacuated.

33. An apparatus according to claim 32, characterized in that the control unit controls the vacuum element in such a manner that the gas pressure in the vacuum space is reduced within 0.1 seconds to the pressure level at which the package is evacuated.

34. An apparatus according to claim 28, characterized in that the control unit controls the vacuum element in such a manner that the gas pressure is reduced to a value of less than 100 mB.

35. An apparatus according to claim 34, characterized in that the control unit controls the vacuum element in such a manner that the gas pressure is reduced to a value of less than 50 mB.

36. An apparatus according to claim 28, characterized in that the control unit controls the sealing means in such a manner that the package is sealed airtightly approximately 0.8–2 seconds after the vacuum space has been vacuumized.

37. An apparatus according to claim 28, characterized in that the apparatus further comprises press-on means for exerting pressure on at least the sidewalls of the package, so that the granular material forms a compact whole.

38. An apparatus according to claim 37, characterized in that the apparatus further comprises a holder for placing the package therein, while the flat walls of at least one pair of opposite sidewalls of the holder, functioning as press-on means, can be pressed towards each other.

39. An apparatus according to claim 37, characterized in that the apparatus further comprises a sack-shaped envelope made of elastic material and of double-walled design, in which envelope the package is arranged, and compressed air elements by which a gas can be blown between the double walls, so that the internal wall of the sack-shaped body presses against the package.

40. An apparatus according to claim 38, characterized in that the apparatus further comprises a sack-shaped envelope made of elastic material and of double-walled design, in which envelope the holder is arranged, and compressed air elements by which a gas can be blown between the double walls, so that the internal wall of the sack-shaped body presses against the package via the flat sidewalls.

41. An apparatus according to claim 38, characterized in that the holder is disposed in the vacuum space.

42. An apparatus according to claim 37, characterized in that the control unit controls the press-on means and the vacuum element in such a manner that the press-on means are energized at least during a part of the time period in which the vacuum elements are energized.

* * * * *